US009109833B2

(12) United States Patent
Delaunay et al.

(10) Patent No.: US 9,109,833 B2
(45) Date of Patent: Aug. 18, 2015

(54) METHOD AND DEVICE FOR COATING METAL STRIPS

(75) Inventors: Didler Delaunay, Maisons-Alfort (FR); Lipp George Jean-Pierre, Maisons-Alfort (FR)

(73) Assignee: FIVES STEIN (FR)

( * ) Notice: Subject to any disclaimer, the term of this patent is extended or adjusted under 35 U.S.C. 154(b) by 131 days.

(21) Appl. No.: 13/639,289

(22) PCT Filed: Apr. 12, 2011

(86) PCT No.: PCT/IB2011/051557

§ 371 (c)(1), (2), (4) Date: Oct. 4, 2012

(87) PCT Pub. No.: WO2011/128834

PCT Pub. Date: Oct. 20, 2011

(65) Prior Publication Data

US 2013/0029055 A1 Jan. 31, 2013

(30) Foreign Application Priority Data

Apr. 13, 2010 (FR) ..... 10 01546
Jun. 4, 2010 (FR) ..... 10 54382

(51) Int. Cl.
*B05C 13/02* (2006.01)
*B05C 3/02* (2006.01)
*F26B 13/00* (2006.01)

(52) U.S. Cl.
CPC ..... *F26B 13/005* (2013.01)

(58) Field of Classification Search
CPC ..... F26B 13/005; B05C 1/0826; B05C 9/02; B05C 9/04
USPC ..... 118/58, 67, 69, 62, 63, 64, 400, 407, 118/50; 427/431, 444; 34/242, 247
See application file for complete search history.

(56) References Cited

U.S. PATENT DOCUMENTS

| | | | | |
|---|---|---|---|---|
| 2,469,270 | A * | 5/1949 | Liebel | 34/66 |
| 2,570,906 | A * | 10/1951 | Alferieff | 427/320 |
| 3,559,280 | A * | 2/1971 | Mailhiot | 29/527.4 |
| 4,152,471 | A * | 5/1979 | Schnedler et al. | 427/310 |
| 4,752,217 | A | 6/1988 | Justus | |
| 5,768,799 | A | 6/1998 | Delaunay et al. | |
| 2004/0007175 | A1 * | 1/2004 | Levendusky et al. | 118/641 |
| 2005/0048216 | A1 * | 3/2005 | Brisberger et al. | 427/431 |

FOREIGN PATENT DOCUMENTS

| | | | |
|---|---|---|---|
| DE | 4226107 | A1 | 2/1994 |
| DE | 19633742 | A1 | 2/1998 |
| DE | 4236299 | C2 | 3/2003 |
| DE | 10062618 | B4 | 4/2004 |
| DE | 10062618 | B4 * | 4/2004 |
| FR | 2734501 | B1 | 7/1997 |
| GB | 1234956 | A | 6/1971 |

* cited by examiner

*Primary Examiner* — Yewebdar Tadesse

(57) ABSTRACT

Method and device for coating a continuously moving metal strip, according to which said strip, after having received its coating, is heated in a heating section, especially for evaporating solvents and for drying or curing the coating, and then cooled in water. A continuous series of sheet-metal elements is provided between the inlet of the tunnel furnace and the outlet of the water cooler so as to make the whole assembly gas-tight, and a device for atmosphere separation by injection of a gas at a temperature above the dew point of the solvents is placed between the outlet of the tunnel furnace and the inlet of the water cooler.

5 Claims, 2 Drawing Sheets

METHOD AND DEVICE FOR COATING METAL STRIPS

PRIORITY

Priority is claimed as a national stage application, under 35 U.S.C. §371, to PCT/IB2011/051557, filed Apr. 12, 2011, which claims priority to French Application No. 1001546, filed Apr. 13, 2010, and to French Application No. 1054382, filed Jun. 4, 2010. The disclosures of the aforementioned priority applications are incorporated herein by reference in their entirety.

The present invention relates to ovens for induction heating continuously moving strips.

It is for example applicable to ovens for drying coatings used for pre- or post-treatment in lines for continuously processing metal strips, especially galvanization lines or heat-treatment lines.

The invention in particular is applicable to drying and curing ovens in metal strip coating lines (coil coating lines).

In the rest of this document, the case of lines for coating coils with protective or decorative coatings using organic-solvent-based paints will more particularly be considered.

Continuous coating of metal strips consists in applying a thin coat of liquid paint to the running strip and drying the paint in an oven.

After baking, the coated strip is then cooled, in general using sprinkled water or by dipping in a water tank.

The paints used generally contain organic solvents. Evaporated in the oven, these solvents are evacuated and destroyed by high-temperature incineration.

Heating of the strip may be carried out in various ways. It is most commonly achieved by hot-air convection heating.

However, other heating methods are used, in particular electromagnetic induction heating. In this case, the temperature of the evacuated gases remains low and as a result solvents and resins condense in the oven and in the incineration circuit.

Patent FR 2 734 501 describes a method for limiting this condensation, consisting in injecting hot air into the heating section and thermally insulating the latter. This hot air is injected and extracted between the induction heaters, in particular so as to limit the chimney effect observed when the tunnel is arranged in a vertical configuration.

However, this design has two drawbacks:

There is still a problem with diffuse emissions from solvent-based products being given off from the strip between the point where the latter exits from the heating section and the point where it enters into the water-cooling section. These diffuse emissions pollute the immediate environment of the machine, coating floors, railings, etc. with slippery residues, and making the air unpleasant and toxic. In addition, these residues are potentially combustible in the event of fire.

In practice, in order to limit the chimney effect, in the case of a vertical heating section, a counterpressure has to be created by adjusting various injection and extraction flow rates along the heating section. This adjustment is difficult to implement and may require additional monitoring of the lower explosive limit in various regions of the section. This may require that the extraction flow rate, and therefore the fuel consumption of the incinerator, be increased.

The invention makes it possible to obviate these drawbacks.

For this purpose, the invention provides a device for coating a continuously moving metal strip, comprising in succession, in the run direction of the strip, a coating section for depositing a coating on the strip, a heating section for evaporating elements, especially solvents, and for drying or baking the coating, and a cooling section, characterized in that:

the casing is continuous between the entrance of the heating section and the exit of the cooling section, so that the assembly is gas-tight; and an atmosphere-separating device is placed between the exit of the heating section and the entrance of the cooling section.

Advantageously, the atmosphere-separating device comprises means for injecting a gas at a temperature above the dew point of the elements to be evaporated. Preferably, the cooling section is a water-cooling section.

The atmosphere-separating device may comprise members allowing the flow cross section and therefore gas flows to be limited.

The atmosphere-separating device may comprise a hot-gas injector placed, in the run direction of the strip, upstream of the members allowing the flow cross section to be limited, and a gas extractor placed downstream.

The oven may comprise a vertical segment in which the strip runs from bottom to top, and in which a deflector roller is placed at the end of the vertical segment allowing the strip to be redirected toward the cooling section, and in that a main hot-gas injector is located at the entrance of the oven and a hot-gas extractor is located level with the deflector casing.

The invention also relates to a process for coating a continuously moving metal strip, in which said strip, after it has been coated, is heated in a heating section for evaporating elements, especially solvents, and for drying or baking the coating, and then cooled, which process is characterized in that:

the casing is continuous between the entrance of the oven and the exit of the water-cooling section, so that the assembly is gas-tight; and a device for separating atmospheres by injecting a gas at a temperature above the dew point of the elements is placed between the exit of the heating section and the entrance of the water-cooling section.

Advantageously, an injector for injecting gas at a temperature above the dew point of the elements is located at the entrance of the oven.

Generally, a main gas extractor is located at the exit of the heating section. An auxiliary gas extractor may be located, in the run direction of the strip, downstream of the atmosphere-separating device.

The auxiliary gas extractor is advantageously located, in the run direction of the strip, upstream of the water-cooling section, the strip preferably being water-cooled.

In a preferred embodiment of the invention the strip is cooled by a water sprinkler.

The continuity of the casing means that the strip remains enclosed from its entrance into the heating section until it exits from the cooling section. The diffuse emissions given off from the strip after it exits the last induction heater may thus be captured and incinerated.

To prevent condensation of the solvents, it is necessary for the internal surface of the enclosure to be kept above the temperature at which said solvents do not condense by thermally insulating the assembly and flushing it with a hot atmosphere, which will need to be incinerated.

Patent FR 2 734 501 describes a solution that comprises fitting a number of extractors and injectors in the baking zone.

The presence of the enclosure according to the invention makes it possible to simplify the extraction and injection circuits. The process according to the invention involves, for example, a hot gas being injected at a single point located at the entrance of the baking tunnel, and extracted at another point just before the water-cooling section.

To avoid increasing the total extraction flow rate of gas extracted from the heating section and cooling section, the ingress of parasitic air, i.e. solvent-free air coming from outside of the oven, is limited.

To do this, an immersion-mode water-cooling tank may be used so as to create a perfectly gas-tight liquid seal.

However, this solution is unsatisfactory in particular because a vertical configuration is required for the water tank, which configuration is more difficult and more costly to implement. Moreover, submersion does not allow only one of the two sides of the strip to be wetted, which may be required for hot application of certain films. In addition, in this configuration the diffuse emissions pollute the cooling water.

It is therefore preferred to use a conventional sprinkler-type cooling method by adding a system for providing a gas seal, of the roller lock type, before the water tank. This separation allows most of the vapory emissions given off to be channeled toward the incineration circuit and not toward the cooling circuit.

Thus, to limit the ingress of solvent-free air from the cooling section, the process according to the invention comprises an atmosphere-separating device placed between the exit of the heating section and the entrance of the water-cooling section.

The atmosphere-separating device according to the invention comprises members allowing the flow cross section and therefore gas flows to be limited.

It may for example be a roller lock comprising at least one pair of rollers placed on either side of the strip. The device may also consist of one or more rollers pressing against one side of the strip and of shutters on the opposite side, placed facing the rollers.

The atmosphere-separating device according to the invention advantageously comprises injecting a gas at a temperature above the dew point of the solvents.

The process according to the invention also comprises an extractor for extracting moist air from the cooling section. This extractor may be placed just downstream of the atmosphere-separating device, and therefore upstream of the cooling section, or at the exit of the water-cooling section.

The process according to the invention makes it possible to prevent diffuse emissions from leaving the oven. Thus, all emissions are captured and incinerated. As a result the machine is cleaner thereby making it less dangerous since there is a smaller risk of fires and slippages, and meaning the surrounding air is less polluted.

This configuration according to the invention prevents condensation of solvents in the gas-flow circuit and also outside of this circuit.

It also enables better control of the extraction flow rate. Parasitic air at room temperature only enters via the entrance of the heating section. This makes it possible to better control the flow rate and the dilution of the extracted solvents. As a result, the fuel consumption of the incinerator is minimized and the machine is safer. The problem in the prior art with balancing of the flow rates in the various branches of the induction tunnel, in particular so as to limit the chimney effect, is thus simplified.

The invention comprises, excluding the features described above, a number of other features of which it will be more explicitly question regarding an exemplary embodiment described with reference to the appended drawings, which embodiment is however in no way limiting. In these drawings.

Figure 1:
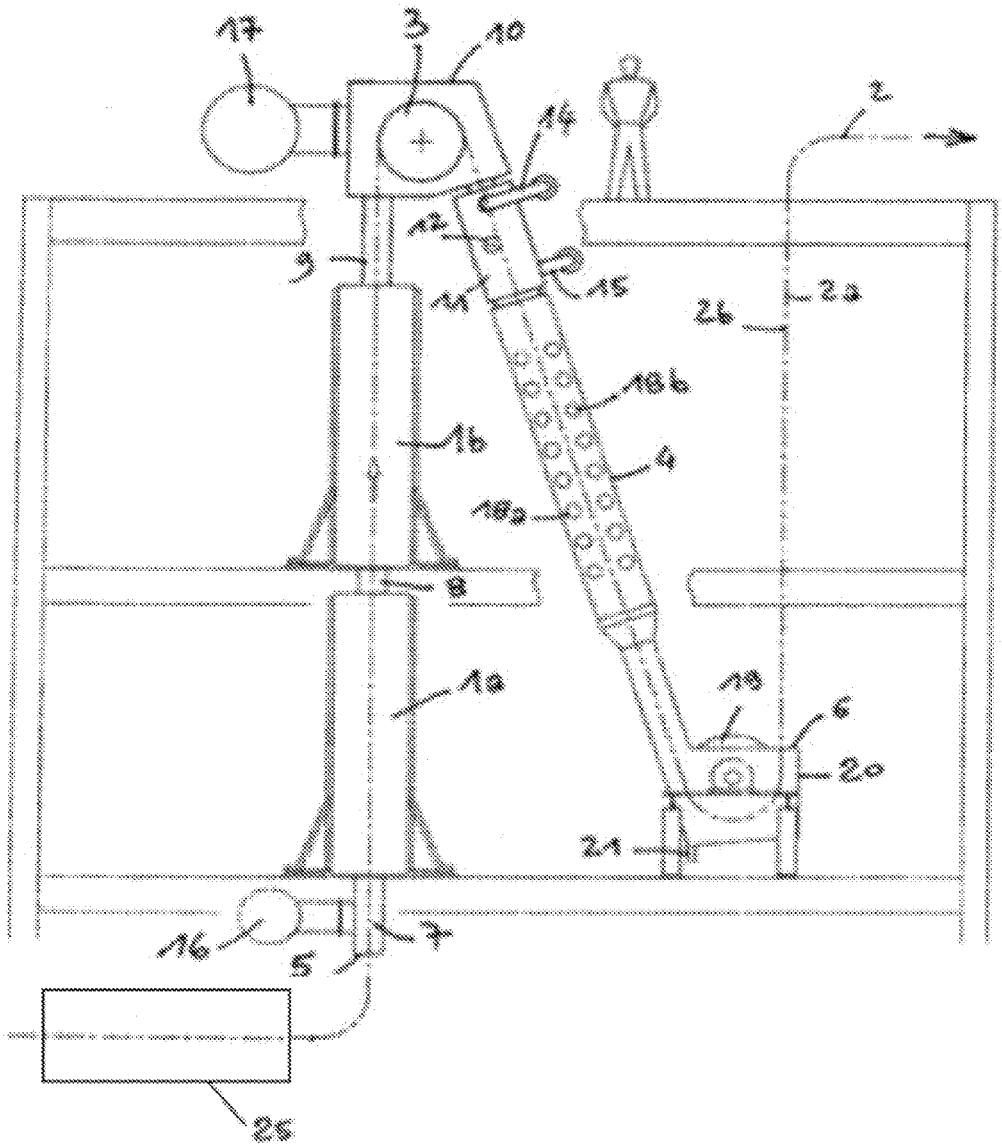
FIG. 1 shows an exemplary induction oven according to the invention.

As shown in FIG. 1, in this embodiment, the oven comprises two induction heaters 1*a* and 1*b* fitted in succession in a vertical segment through which the strip 2 runs from bottom to top. A deflector roller 3, placed at the end of the vertical segment, allows the strip to be redirected toward the cooling section 4.

The cooling section 4 comprises a first part equipped with a number of rails 18*a* and 18*b* for spraying water onto the strip and a water tank 20 allowing the water that runs off the upper part to be collected. A tap 21 allows the water to be returned to the rails 18*a* and 18*b* via a closed circuit (not shown) comprising a finned heat exchanger.

The strip 2 runs from a coating section 25, in which a coating is deposited on the strip 2, to the entrance 5 of the oven. From the entrance 5 of the oven to its exit 6, the strip is kept in a dosed envelope formed by the successive internal was of the entrance casing 7 of the induction heater 1*a*, of the linking casing 8 of the induction heater 1*b*, of the linking casing 9, of the deflector casing 10, of the atmosphere-separating device 11 and of the water-cooling section 4 and the water tank 20.

A main hot-gas injector 16 is located at the entrance of the oven and a hot-gas extractor 17 is located level with the deflector casing 10.

The hot gas injected at the injection points 16 and 14 is advantageously air that has been preheated by the flue-gases from incineration of the solvents. Its temperature at the injection points depends on the condensation temperature of the solvents. It is typically above 200° C.

Figure 2:
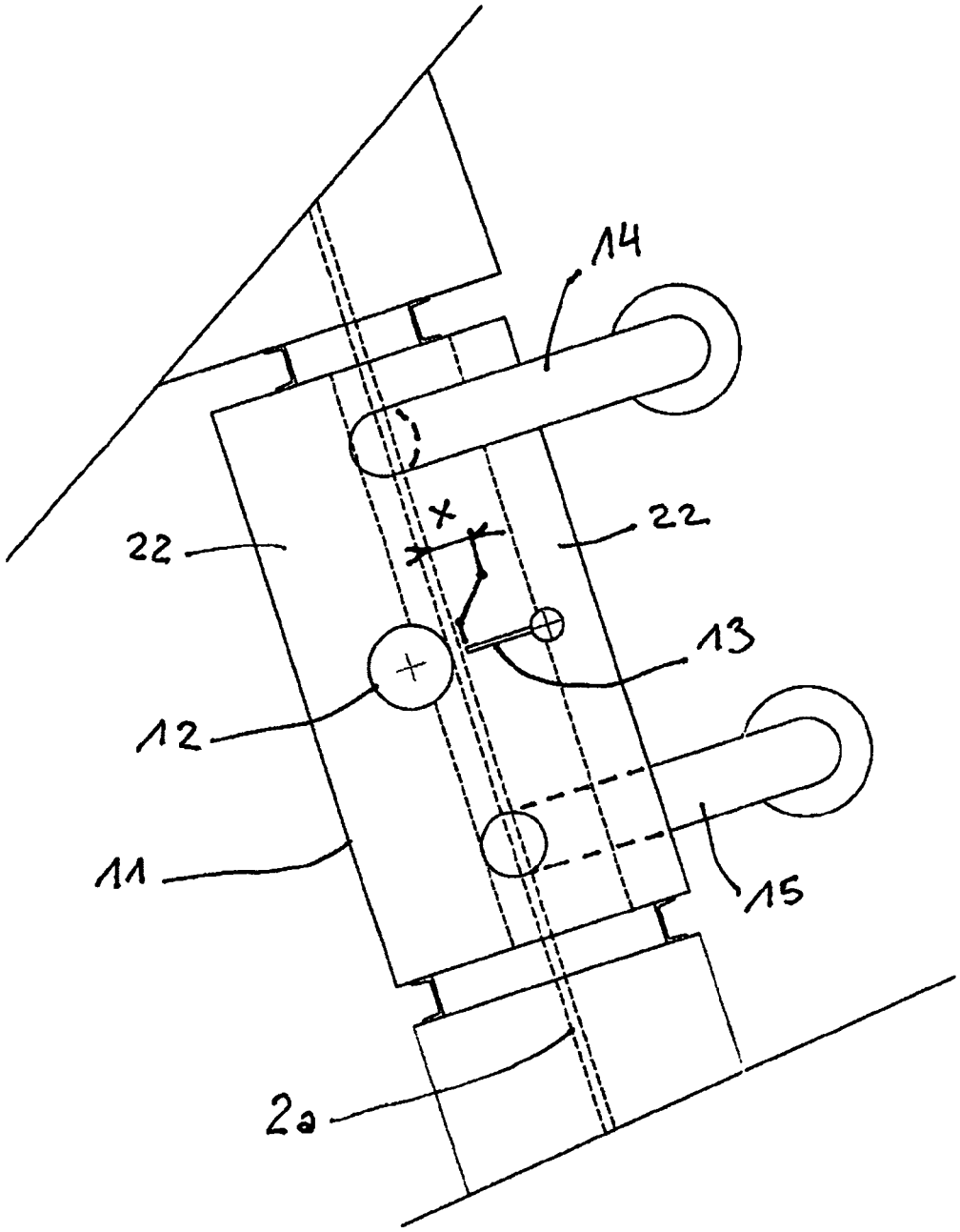
FIG. 2 shows an enlargement of the atmosphere-separating device 11 according to the exemplary embodiment in FIG. 1.

As shown in FIG. 2, in this embodiment, the atmosphere-separating device 11 comprises a supporting roller 12 on which the side 2*a* of the strip rests, and, facing on the opposite side, a retractable shutter 13 that limits the flow cross section through which the atmosphere can pass. It also comprises a hot-gas injector 14 placed, in the run direction of the strip, upstream of the roller 12 and shutter 13 assembly, and a gas extractor 15 placed downstream.

To limit the risk of marking the strip, the roller 12 may be motorized and its rotation speed adjusted so that the peripheral speed of the roller is identical to that of the strip. As a variant, the roller 12 may be set back slightly from the line along which the strip passes so that the latter does not press against the roller in normal operation but only from time to time, for example when the tension in the strip varies during transitory phases.

An isolating member 22 allows the cross section left free for gases to flow to be limited. An operational play between the roller 12 and the isolating member allows the roller to rotate while limiting gas flow between the upstream and downstream sides of the roller 12.

The shutter 13 can be retracted so as to allow the strip to be introduced into the oven. The roller 12 allows the position of the strip to be controlled and thus the opening X between the end of the shutter 13 and the strip to be minimized. An operational play between the shutter 13 and the isolating member allows the shutter to rotate while limiting gas flow between the upstream and downstream sides of the shutter 13.

According to another embodiment (not shown), the atmosphere-separating device 11 comprises two roller 12 and shutter 13 assemblies in succession. This configuration makes it possible to increase the gas-tightness of the device by increasing the head loss of the moving gas.

Upstream, in the run direction of the strip, of the roller 12 and shutter 13 assembly, the combination of the two hot-gas injectors 14 and 16 and the extractor 17 allows the internal walls of the heating section to be kept, from the entrance 5 to the roller and shutter 13 assembly, at a temperature high enough to prevent condensation of the solvents. It also ensures that solvents are removed to the incinerator.

The exit 6 of the water-cooling section 4 is in open air.

Downstream, in the run direction of the strip, of the roller 12 and shutter 13 assembly, the combination of the extraction point 15 and the ingress of air via the exit 6 of the cooling section ensures that residual solvents given off by the coating of the strip are removed to the incinerator.

According to another exemplary embodiment (not shown), the strip segment located between the deflector roller 3 and the exit of the water-cooling section is horizontal.

The invention claimed is:

1. A device for coating a continuously moving metal strip, comprising in succession, in the run direction of the strip, a coating section for depositing a coating on the strip, a heating section for evaporating elements, the elements including a solvent, and for drying or baking the coating, and a cooling section, wherein:

a casing is continuous between the entrance of the heating section and the exit of the cooling section, the casing being gas-tight; and an atmosphere-separating device is placed between the exit of the heating section and the entrance of the cooling section, wherein the atmosphere-separating device is configured to inject a gas into the casing, between the exit of the heating section and the entrance of the cooling section, at a temperature above the dew point of the elements to be evaporated.

2. The device as claimed in claim 1, wherein the cooling section is a water-cooling section.

3. The device as claimed in claim 1, wherein the atmosphere-separating device comprises members allowing the flow cross section and therefore gas flows to be limited.

4. The device as claimed in claim 3, wherein the atmosphere-separating device comprises a hot-gas injector placed, in the run direction of the strip, upstream of the atmosphere-separating device, and a gas extractor placed downstream.

5. The device as claimed in claim 1, further comprising a vertical segment in which the strip runs from bottom to top through the heating section, a deflector roller placed in a deflector casing at the end of the vertical segment and configured to redirect the strip toward the cooling section, a main hot-gas injector located at an entrance of the heating section, and a hot-gas extractor located level with the deflector casing.

* * * * *